United States Patent [19]

Bomgardner et al.

[11] Patent Number: 5,025,938

[45] Date of Patent: Jun. 25, 1991

[54] RAIL CAR CUSHION SLIDER VALVE

[75] Inventors: Charles T. Bomgardner, Burleson; D. Bradley Dumler, Arlington, both of Tex.

[73] Assignee: FM Industries, Inc., Ft. Worth, Tex.

[21] Appl. No.: 450,170

[22] Filed: Dec. 13, 1989

[51] Int. Cl.[5] ..... B61G 9/00

[52] U.S. Cl. ..... 213/43; 188/322.17

[58] Field of Search ..... 213/43, 10, 223, 41; 188/322.17, 313, 318, 315

[56] References Cited

U.S. PATENT DOCUMENTS

| | | | |
|---|---|---|---|
| 1,373,315 | 3/1921 | Dunn | 213/43 |
| 2,785,774 | 3/1957 | Long et al. | 188/313 |
| 3,301,410 | 1/1967 | Seay | 213/43 |
| 3,568,855 | 3/1971 | Seay | 213/43 |
| 3,589,527 | 6/1971 | Seay | 213/43 |
| 3,589,528 | 6/1971 | Stephenson | 213/43 |
| 3,743,109 | 7/1973 | Hutchison | 213/43 |
| 4,026,418 | 5/1977 | Hawthorne | 213/43 |
| 4,739,889 | 4/1988 | Bomgardner | 213/43 |
| 4,925,436 | 5/1990 | Hayashi et al. | 188/313 |

FOREIGN PATENT DOCUMENTS

| | | | |
|---|---|---|---|
| 0126831 | 12/1949 | Sweden | 188/313 |
| 0364662 | 11/1962 | Switzerland | 213/43 |

*Primary Examiner*—Robert J. Oberleitner
*Assistant Examiner*—Mark T. Le
*Attorney, Agent, or Firm*—James E. Bradley

[57] ABSTRACT

A rail car cushion apparatus comprises concentric cylinder and housing members mounted at one end to a seat of a cushion apparatus body and at the other end to a cylinder head. The cylinder head includes a flow chamber and flow passages. A sleeve valve chamber is also included in the cylinder head adjacent to the flow chamber. A sleeve valve is provided in the sleeve valve chamber and is slidably mounted to slide along a piston rod telescopically received in the concentric cylinder and housing members. The sleeve valve is confined for limited movement by a sleeve retainer lip provided in the cylinder head. The retainer lip is discontinous to provide space for the sleeve valve to be inserted into the sleeve valve chamber. The sleeve valve retainer lip alternatively may be formed by a flexible retainer member retained in a groove formed in the cylinder head.

7 Claims, 2 Drawing Sheets

RAIL CAR CUSHION SLIDER VALVE

FIELD OF THE INVENTION

The present invention generally pertains to rail car cushioning devices, and more particularly to improved slider valve and cylinder head apparatus incorporated into a rail car cushioning device.

BACKGROUND OF THE INVENTION

Typical end-of-car rail car cushioning devices of the type suitable for incorporating the present invention are shown in U.S. Pat. No. 3,568,855 to Seay et al; U.S. Pat. No. 3,589,527 to Seay et al; U.S. Pat. No. 4,026,418 to Hawthorn; and U.S. Pat. No. 4,739,889 to Bomgardner.

Such end-of-car cushioning devices may be installed in a new freight car or in a freight car which is brought into a shop and rebuilt.

After the cushioning devices have been installed and the rail car is put into service, the rail car is repeatedly used over a period of many months, or many years, with little or no inspection or maintenance.

The cushioning devices continue to be used until the respective rail car is brought into a shop for overhaul or rebuild, or until a particular cushioning device obviously has failed and becomes inoperative. The cushioning device which has failed is usually rebuilt with all worn or broken parts being replaced with new parts. The resulting rebuilt unit is substantially of the same quality as a new unit.

The new cushioning devices incorporate the improvements which extend the useful service life of the cushioning devices and also improvements which reduce the cost of the cushioning devices.

The older cushioning devices of a particular model, which are returned for overhaul and rebuild, incorporate only the improvements for that particular model where the older devices are suitable to incorporate the improvements. The older devices become obsolete when the older units are no longer suitable for rebuild into devices acceptable for further use.

The improved cylinder head and slider valve apparatus of the present invention is valuable when incorporated into new cushioning apparatus and also when incorporated as replacement components of rebuilt cushioning apparatus.

OBJECTS OF THE INVENTION

It is an object of the present invention to consolidate component parts of a rod end cylinder head assembly into an integral cylinder head which also serves as a portion of the cylinder head valve.

It is another object of the present invention to provide a slider valve which interacts with the piston rod and the cylinder head to move with movement of the piston rod from an open to a closed flow position and return.

It is a further object of the present invention to reduce the manufacturing cost of the cylinder head and valve components.

It is yet another object of the present invention to provide an improved cushioning apparatus which may function for a longer time period before repairs are needed.

SUMMARY OF THE INVENTION

The foregoing and other objects and advantages of the invention are attained in a rail car cushion apparatus which includes a cylinder having a first end mounted into a first cylinder seat of a cushion apparatus body and a second end mounted into a second cylinder seat of a rod end cylinder head with a piston slidably mounted in the cylinder and connected to a piston rod slidably mounted in a piston rod bore extending through the cylinder head. A support housing has a first end mounted to the cushion apparatus body and a second end mounted to the cylinder head and shaped to form an annular reservoir between the support housing and the cylinder.

A flow chamber and flow passages are formed in the cylinder head for providing liquid flow from the reservoir to around the piston rod within the cylinder. A sleeve valve chamber is formed in the cylinder head adjacent to the flow chamber and by a sleeve valve retainer lip formed by the cylinder head. A sleeve valve is slidably mounted to slide along the piston rod. The sleeve valve is located within the sleeve valve chamber. The sleeve valve is confined for limited movement by the sleeve retainer lip. The sleeve valve forms a liquid seal between the flow chamber and the sleeve valve chamber when moved by the piston rod in a first direction and permits liquid flow through the flow chamber and the sleeve valve chamber when moved by the piston rod in a second direction. The sleeve valve retainer lip is discontinuous to provide space for the sleeve valve to be tilted and slipped past the retainer lip into the sleeve valve chamber before the piston rod is inserted into the rod bore. The sleeve valve retainer lip alternately may be formed by a flexible retainer means flexed to be inserted into and retained in a retainer groove formed by the cylinder head. A hand-insertable sleeve bearing may be inserted into the rod bore and retained within the bore by a resilient snap ring before the piston rod is inserted into the rod bore.

DESCRIPTION OF A PREFERRED EMBODIMENT

Figure 1:
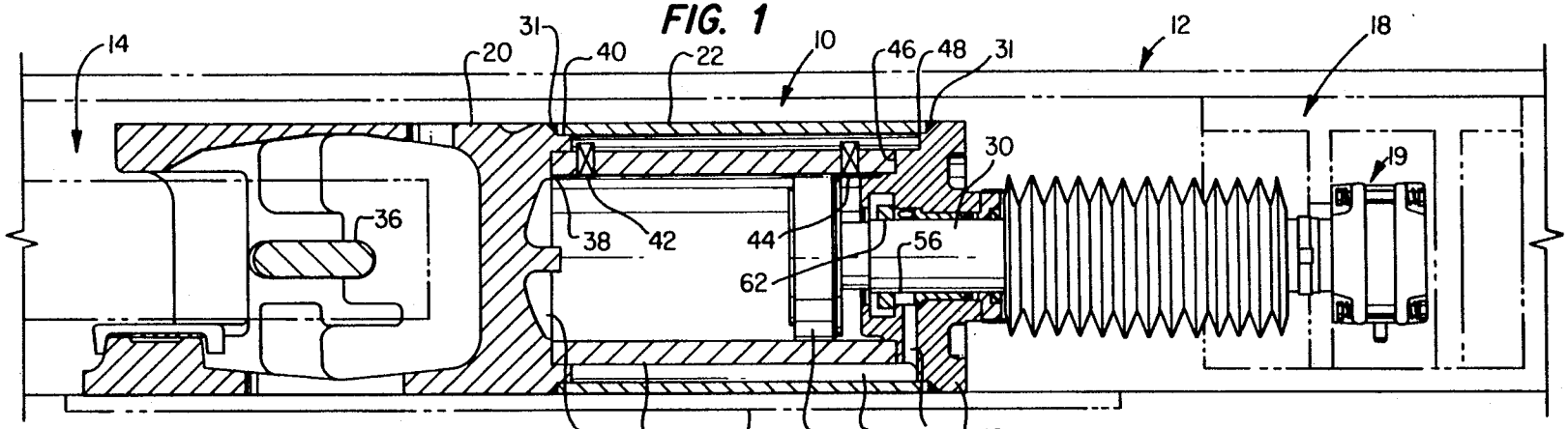
FIG. 1 is a partly sectional, partly elevational, and partly schematic view of a rail car cushioning apparatus which incorporates the present invention.

FIG. 1 illustrates a cushion apparatus 10 mounted into a railway car front sill framework 12 and supported by a sill base plate 16. A piston rod retainer bearing 19 is positioned within a retainer bearing structure support housing 18, also mounted within the railway car sill framework 12.

The cushion apparatus 10 includes a body 20 attached to a support housing 22. An operating cylinder 26 is mounted with the body 20 and within the support housing 22 which forms a reservoir 24 between the support housing and the operating cylinder.

A piston 28 attached to a piston rod 30 is mounted within the operating cylinder 26.

The operating cylinder 26 is mounted on one end at a piston end cylinder bulkhead 34 in a bulkhead cylinder seat 38 and at the other end in a rod end cylinder seat 46 of a cylinder head 32.

The support housing 22 is mounted at one end in a body housing seat 40 forming a part of the body 20 and at the other end in a cylinder head housing seat 48 formed in the cylinder head 32. The support housing 22 is integrally connected at seats 40 and 48 by welds 31.

A coupler bar and coupler 14 is retained in the outer end of the body 20 by a coupler retainer key 36.

A buff flow control valve 42 is schematically illustrated through the wall of the operating cylinder 26 between the cylinder bulkhead 34 and the piston 28.

A draft flow control valve 44 is schematically illustrated as being in the wall of the operating cylinder 26 between the piston 28 and the cylinder head 32.

Different types of valves or metering ports can be utilized at the flow control valve 42 and the flow control valve 44, and such flow control mechanisms are provided to meter the flow passage of hydraulic fluid within the operating cylinder 26 and thereby control the rate of movement of the piston 28 either in buff or in draft movement of the cushion apparatus 10 and the coupler 14 within the railway car sill framework 12.

As best illustrated in FIGS. 2–5, the cylinder head 32 is an integral member formed to provide a housing seat 48 and the cylinder seat 46 to form the fluid reservoir 24. The cylinder head 32 is also formed to provide a plurality of buff flow passages 54 which converge into a buff flow chamber 56 which in turn opens into a slider valve sleeve chamber 58. The slider valve sleeve chamber 58 is formed to contain and retain a slider valve 62 which is mounted in sliding relation along the piston rod 30.

The fit of the slider valve 62 on the rod 30 may be in the order of a close running fit $RC_4$ to permit free movement of the sleeve valve on the rod yet providing an effective fluid seal between the sleeve valve and the rod. The sleeve valve 62 is retained within the valve sleeve chamber 58 by means of a slider valve retainer lip 60 integrally formed on the end of valve sleeve chamber 58 of the cylinder head 32.

Figure 4:
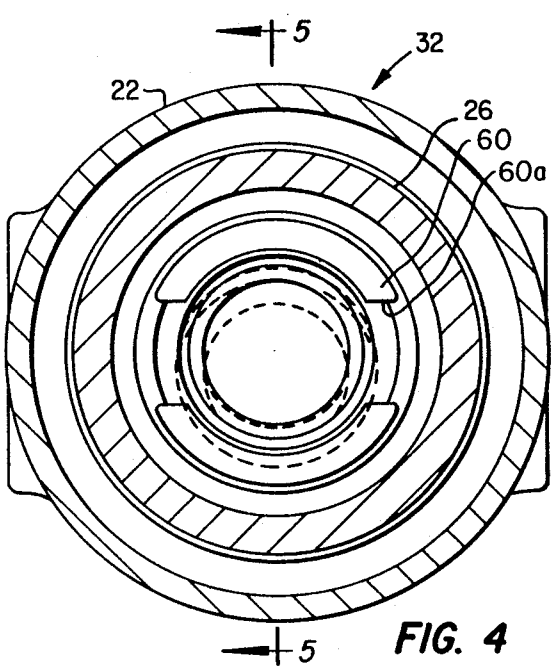
FIG. 4 is a view taken along the line 4—4 of FIG. 5 during assembly of the sleeve valve into the sleeve valve chamber.
Figure 3:
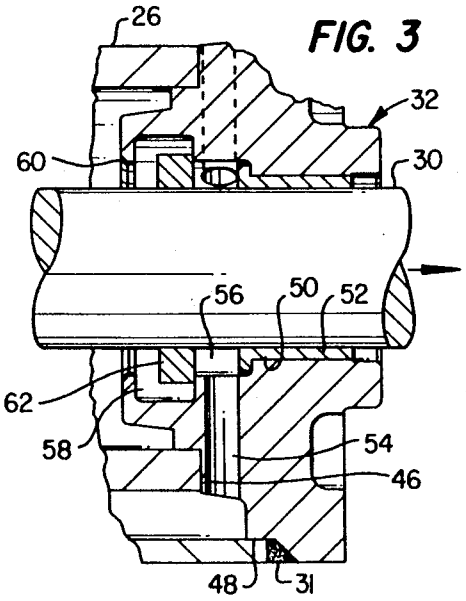
FIG. 3 is a view similar to FIG. 2, but showing the sleeve valve in a second position responsive to an opposite movement of the piston rod.
Figure 2:
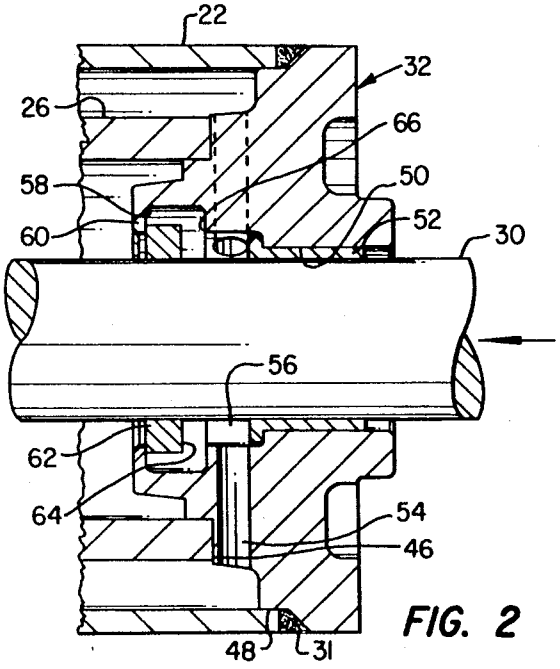
FIG. 2 is a larger and more detailed cross-sectional view of the cylinder head portion of FIG. 1 and showing the sleeve valve in a first position.
Figure 5:
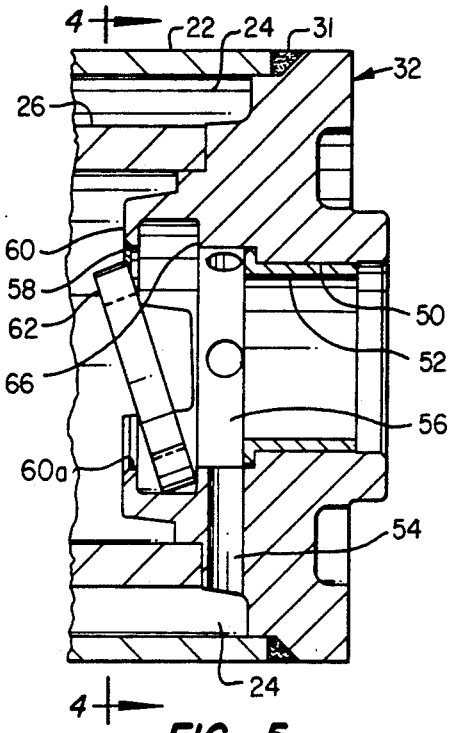
FIG. 5 is a cross-sectional and elevational view as taken along the line 5—5 of FIG. 4 with a corresponding view of the sleeve valve during assembly.

As better shown in FIGS. 4 and 5, a portion of the valve retainer lip 60 has been enlarged to permit the entry of the sleeve valve 62 into the valve sleeve chamber 58 when inclined and slid into place within the sleeve chamber 58 as shown before the piston rod 30 is inserted into and through the cylinder head 32. The portion removed comprises two discontinuous portions **60*a* spaced opposite each other, through which the tilted sleeve valve 62 may be inserted. Retainer lip 60 thus has two circumferentially extending portions separated by the discontinuous portions 60*a***.

The cylinder head 32 forms a bore 50 receiving a sleeve bearing 52 which receives the piston rod 30 to support the piston rod 30 in reciprocating and sliding relationship within the cylinder head 32.

As the slider sleeve valve 62 is reciprocated back and forth through the cylinder head 32, the slider valve 62 is moved from a first position against the retainer lip 60 to a second position at the juncture of the valve sleeve chamber 58 and the buff flow chamber 56 and against a sealing surface 66 formed at this juncture.

A portion of the sleeve valve 62 forms a sleeve sealing surface 64 to create a seal between the sealing surface 64 and the sealing surface 66 as the cylinder 26 is moved in buff with relation to the piston 28.

In the usual operation, the piston 28 remains in the position shown in FIG. 1 in the absence of external force applied to the coupler 14 by means of a charge of compressible gas under pressure in the chamber 24 acting across the cross-sectional area of the piston 30 at the bearing 52 or, alternately, by external mechanical springs (not shown) in earlier models of cushion apparatus 10.

When a buff force is applied against the coupler 14, the force tends to move the housing of the apparatus 10 farther back within the sill framework 12. The piston 28, responsive to such movement, applies a very high liquid pressure within the cylinder 26 between the piston 28 and the cylinder bulkhead 34.

The high pressure is relieved by metered liquid flow through a valve 42 as schematically illustrated, and the escaping liquid from within the chamber is passed into the reservoir 24. This flow rate controls the buff movement rate of body 20 within the sill framework 12 of a rail car.

At the same time liquid is freely passing from the reservoir 24 through the passages 54, the buff flow chamber 56, the slider sleeve chamber 58, and past the retainer lip 60 to occupy the increasing space behind the piston 28 and around the rod 30.

When a draft force is applied against the coupler 14, the piston is urged toward the cylinder head 32 and movement of the piston rod 30 urges the seal sleeve valve 62 into sealed relation with the sealing surface 66 and thereby causes the fluid exited from behind the piston 28 to be forced through the valve 44 as schematically shown and thus control the rate of draft movement of the cushion apparatus 10 in sill framework 12.

Figure 6:
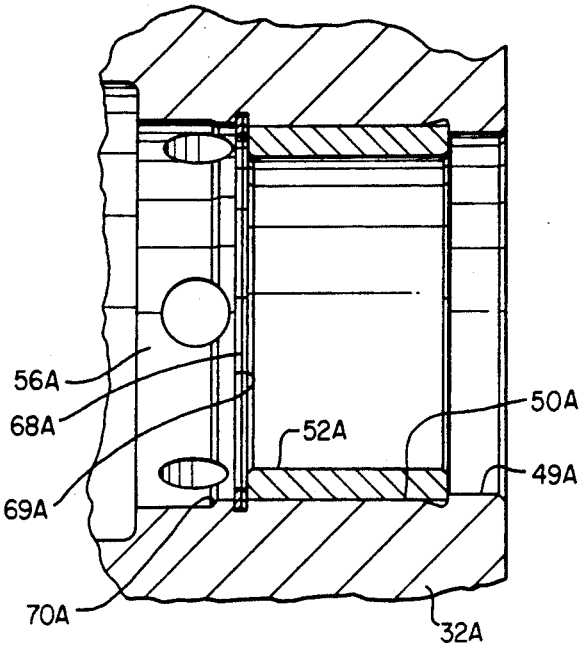
FIG. 6 is a cross-sectional view of an alternate embodiment of a piston rod bearing structure.

FIG. 6 illustrates a new installation of the piston rod bushing 52A within the cylinder head for easier and less expensive installation and removal of the bushing during assembly and disassembly of the apparatus 10. As shown, a bore 50A is a counterbore with a land 49A to receive and support the end of the bushing 52A which may be slipped easily into the bore 50A. The bushing 52A, when installed as shown, is retained into position until subsequently removed by removal of one or more bushing snap retainer rings 68A which are inserted and retained in a corresponding groove 69A as shown. In this embodiment, a further counterbore is provided in chamber 56A which terminates in a taper 70A to facilitate entry of the bushing 52A into the bore 50A.

Figure 7:
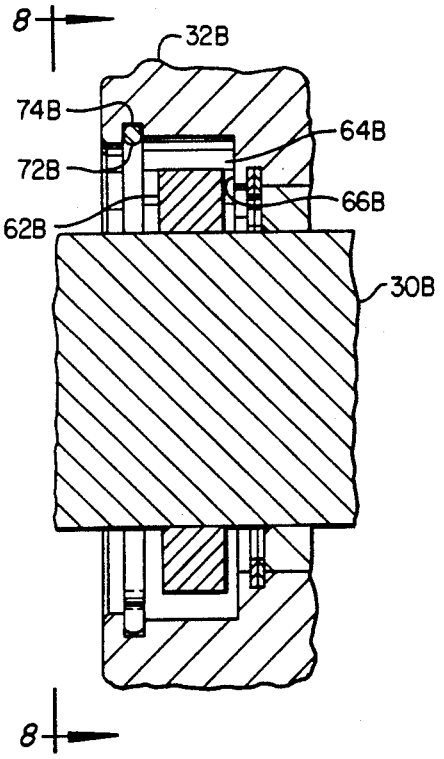
FIG. 7 is a cross-sectional view generally corresponding to FIGS. 2, 3 and 5 and showing an alternate construction to retain the sliding sleeve valve in operative position.
Figure 8:
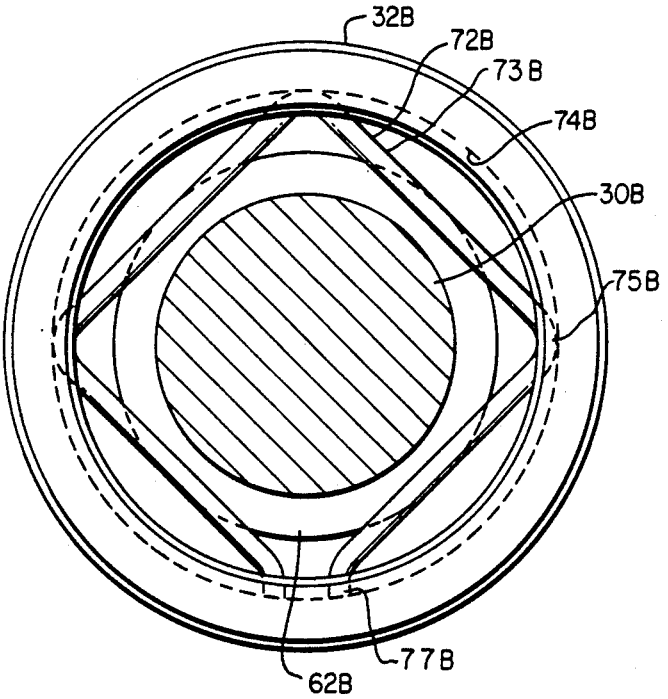
FIG. 8 is an elevational view of the structure of FIG. 7 as taken along the line 8—8 of FIG. 7.

An alternate installation of the sleeve valve within the sleeve valve chamber is illustrated in FIGS. 7 and 8. As shown, a slider valve sleeve valve 62B is retained in a slider valve sleeve chamber by means of an elastic retainer spring 72B retracted and inserted into a retainer spring groove 74B. Retainer spring **72*b* is rectangular and has four straight sides 73*b* joined by three corners 75*b*. the retainer spring 72*b* has two parallel free ends 77*b* at one corner which insert into the groove 74*b*. The corners 75*b* also insert into groove 74*b*. The sleeve valve 62*b* will contact the straight sides 72*b* when moved away from the sealing surface 66b. The sleeve valve 62B is thereon positioned to engage the sleeve sealing surface 64B with the cylinder head sealing surface 66B for operation as previously described with reference to FIGS. 2 and 5**.

The difference between the embodiments is in the installation and removal of the sleeve valve 62B. Here, the sleeve valve retainer spring 72B is flexed and removed from the retainer spring groove 74B where the sleeve valve 62B may be readily removed. During assembly, of course, the sleeve valve 62B is inserted in the sleeve valve chamber and the sleeve retainer spring 72B is flexed and inserted into the retainer spring groove 74B and thereon released to retain the sleeve valve within the chamber as previously described.

The assembly of cushion apparatus 10 is the same whether the apparatus is a new unit or a rebuilt unit. If the unit is being rebuilt, it is most likely being upgraded to the improvement of the structure of the cylinder head 32 as herein described. The weld 31 which joins the housing 22 with the cylinder head 32 has been cut away and the contents of the housing 22, including the cylinder 26, the piston 28, the rod 30, and the piston head 28 have been removed. All replacement parts are new or of new quality when the cushion apparatus 10 is being assembled. The piston head 32 first receives the installation of a rod bushing 52, either the version shown in FIGS. 2–5, or the version shown in FIG. 6. Next, the slider sleeve valve 62 is installed within the valve sleeve chamber 58, either by cocking the sleeve valve and inserting it past the openings in the lip 60 as shown in FIGS. 4 and 5, or by installation as shown in FIG. 7 to be retained by a retainer spring as shown in FIGS. 7 and 8.

The piston rod and piston are then installed in the cylinder head 32. The cylinder 26, equipped with the flow metering valves 42 and 44, is then fitted about the piston 28 onto the seat 46 of the cylinder head 32. This assembly is then mounted into the housing 22 with the cylinder 26 seating in the cylinder seat 38 and the housing 22 seating into the cylinder head housing seat 48. The assembly is then clamped into alignment and permanently assembled by means of the welds 31 all around.

The cylinder housing 22 and the chambers within the cylinder 26 are next filled with hydraulic fluid in prescribed amount to leave a small space which is filled with gas under pressure, such as nitrogen for example, through an entry port (not shown). The remainder of the cushioning apparatus 10, including the retainer bearing structure 19, is assembled together as shown and the cushioning apparatus 10 is then exercised and packaged for shipment.

When installed in a railway car, the bearing structure 19 is installed into a support housing 18 as shown and the cushioning apparatus 10 is mounted up within a sill structure 12 and retained by a retainer plate 16 as shown in FIG. 1. The coupler 14 is retained into position by means of the coupler retainer key 36.

As may be seen, the embodiments herein shown may be modified and changed to a considerable extent while remaining within the scope and purview of the appended claims.

What is claimed is:

1. A rail car cushioning apparatus including: a cylinder having a first end mounted into a first cylinder seat of a cushion apparatus body and a second end mounted into a second cylinder seat of a rid end cylinder head; a piston slidably mounted in said cylinder and connected to a piston rod which is slidably mounted in a piston rod bore extending through said cylinder head; a support housing having a first end mounted to said cushion apparatus body and a second end mounted to said cylinder apparatus body and a second reservoir between said support housing and said cylinder; said apparatus further comprising:

a) a flow chamber and flow passage means in said cylinder head for providing liquid flow from said reservoir to around said piston rod within said cylinder;

b) a sleeve valve chamber formed in said cylinder head adjacent to said flow chamber and a sleeve valve retainer lip;

c) a sleeve valve means mounted to slide along said piston rod;

d) said sleeve valve means being located within said sleeve valve chamber;

e) said sleeve valve means being confined for limited movement by said sleeve valve retainer lip;

f) said sleeve valve means forming a liquid seal between said flow chamber and said sleeve valve chamber when moved during movement of said piston rod in a first direction and permitting liquid flow through said flow chamber and said sleeve valve chamber when moved during movement of said piston rod in a second direction; and g) said sleeve valve retainer lip having discontinuous portions on opposite sides from each other to provide space for said sleeve valve means to be tilted and slipped through said discontinuous portions past said retainer lip into said sleeve valve chamber before said piston rod is inserted into said rod bore.

2. The apparatus of claim 1 wherein said sleeve valve retainer lip is formed by a flexible retainer means flexed to be inserted into and retained in a retainer groove formed by said cylinder head.

3. The apparatus of claim 1 wherein a hand insertable sleeve bearing is inserted into said rod bore and retained within said bore by resilient snap ring means.

4. The apparatus of claim 2 wherein said flexible retainer means is a flexible wire spring.

5. The apparatus of claim 1 further comprising a sleeve bearing inserted into said rod bore for slidably supporting said piston rod and retained within said bore by resilient snap ring means located between said bore and said flow chamber.

6. A rail car cushioning apparatus including: a cylinder having a first end mounted into a first cylinder seat of a cushion apparatus body and a second end mounted into a second cylinder seat of a rod end cylinder head assembly; a piston slidably mounted in said cylinder and connected to a piston rod which is slidably mounted in a piston rod bore extending through said cylinder head assembly; a support housing having a first end mounted to said cushion apparatus body and a second end mounted to said cylinder head assembly to form an annular reservoir between said support housing and said cylinder; said apparatus further comprising:

a flow chamber and flow passage means in said cylinder head assembly for providing liquid flow from said reservoir to around said piston rod within said cylinder;

a sleeve valve chamber formed in a said cylinder head assembly adjacent to said flow chamber and having a sleeve valve sealing surface;

a sleeve valve retainer lip integrally formed on said sleeve valve chamber on an opposite end of said sleeve valve chamber from said sleeve valve sealing surface;

an annular sleeve valve mounted to slide along said piston rod;

said sleeve valve being located within said sleeve valve chamber;

said sleeve valve being confined for limited movement in a first direction by contact of said sleeve valve with said sleeve valve sealing surface and for limited movement in a second direction by contact of said sleeve valve with said sleeve valve retainer lip;

said sleeve valve forming a liquid seal between said flow chamber and said sleeve valve chamber when moved during movement of said piston rod in the first direction into contact with said sleeve valve sealing surface;

said sleeve valve permitting liquid flow through said flow chamber and said sleeve valve chamber when moved during movement of said piston rod in a second direction into contact with said sleeve valve retainer lip; and said sleeve valve retainer lip having two circumferentially extending portions separated by two discontinuous portions, said discontinuous portions being located on opposite sides from each other to provide space for said sleeve valve to be tilted and slipped through said discontinuous portions past said circumferentially extending portions into said sleeve valve chamber before said piston rod is inserted into said rod bore.

7. A rail car cushioning apparatus including: a cylinder having a first end mounted into a first cylinder seat of a cushion apparatus body and a second end mounted into a second cylinder seat of a rod end cylinder head assembly; a piston slidably mounted in said cylinder and connected to a piston rod which is slidably mounted in a piston rod bore extending through said cylinder head assembly; a support housing having a first end mounted to said cushion apparatus body and a second end mounted to said cylinder head assembly to form an annular reservoir between said support housing and said cylinder; said apparatus further comprising:

a flow chamber and flow passage means in said cylinder head assembly for providing liquid flow from said reservoir to around said piston rod within said cylinder;

a sleeve valve chamber formed in a said cylinder head assembly adjacent to said flow chamber and having a sleeve valve sealing surface;

a retainer groove integrally formed in said sleeve valve chamber on a second end of said sleeve valve chamber;

a retainer spring having a rectangular configuration with four straight sides joined by three adjacent corners, the retainer spring terminating in two parallel ends, the corners and the ends being insertable in the retainer groove to retain the retainer spring at the second end of said sleeve valve chamber;

an annular sleeve valve mounted to slide along said piston rod;

said sleeve valve being located within said sleeve valve chamber;

said sleeve valve being confined for limited movement in a first direction by contact of said sleeve valve with said sleeve valve sealing surface and for limited movement in a second direction by contact of said sleeve valve with said straight sides of said retainer spring;

said sleeve valve forming a liquid seal between said flow chamber and said sleeve valve chamber when moved during movement of said piston rod in the first direction into contact with said sleeve valve sealing surface; and said sleeve valve permitting liquid flow through said flow chamber and said sleeve valve chamber when moved during movement of said piston rod in a second direction into contact with said retainer spring.

* * * * *